US005533778A

United States Patent [19]

Sheridan

[11] Patent Number: 5,533,778

[45] Date of Patent: Jul. 9, 1996

[54] PROJECTILE RESISTANT WINDOW SHIELD

[76] Inventor: Ronald J. Sheridan, 1890 Tropic St., Titusville, Fla. 32796

[21] Appl. No.: 168,227

[22] Filed: Dec. 17, 1993

[51] Int. Cl.[6] ..... B60J 1/17

[52] U.S. Cl. ..... 296/152; 49/50; 89/36.07

[58] Field of Search ..... 296/97.7, 152; 49/50, 61; 89/36.07, 36.09, 36.08

[56] References Cited

U.S. PATENT DOCUMENTS

| | | | |
|---|---|---|---|
| 2,723,823 | 11/1955 | Polk, Jr. | 296/97.7 X |
| 3,923,339 | 12/1975 | McDonald | 296/95.1 |
| 5,271,311 | 12/1993 | Madden, Jr. | 89/36.08 |

FOREIGN PATENT DOCUMENTS

| | | | |
|---|---|---|---|
| 1168195 | 12/1958 | France | 89/36.07 |
| 0135625 | 12/1929 | Switzerland | 296/97.7 |

*Primary Examiner*—David M. Mitchell
*Assistant Examiner*—Kia M. Robinson
*Attorney, Agent, or Firm*—John B. Dickman, III

[57] ABSTRACT

A window shield including a transparent projectile resistant panel mounted on the inside of a vehicle door frame covering the window opening, and a removable bracket support connected to the panel. An additional panel can be fastened by snaps to the bracket support to protect the lower portion of a driver's body if necessary.

3 Claims, 4 Drawing Sheets

FIG. 2
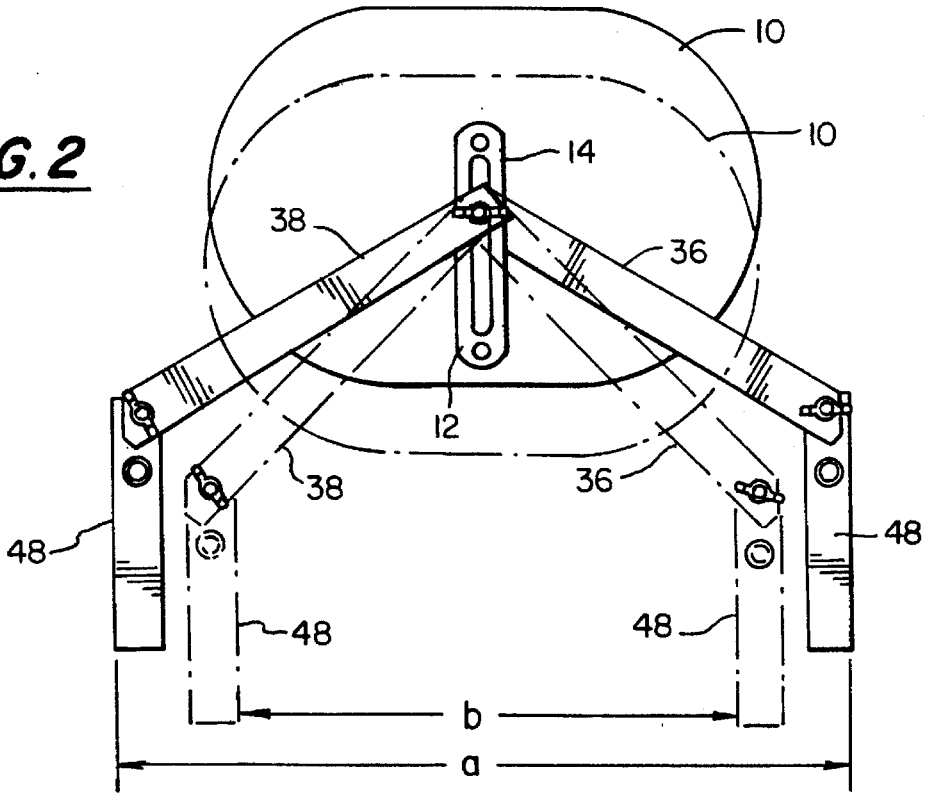
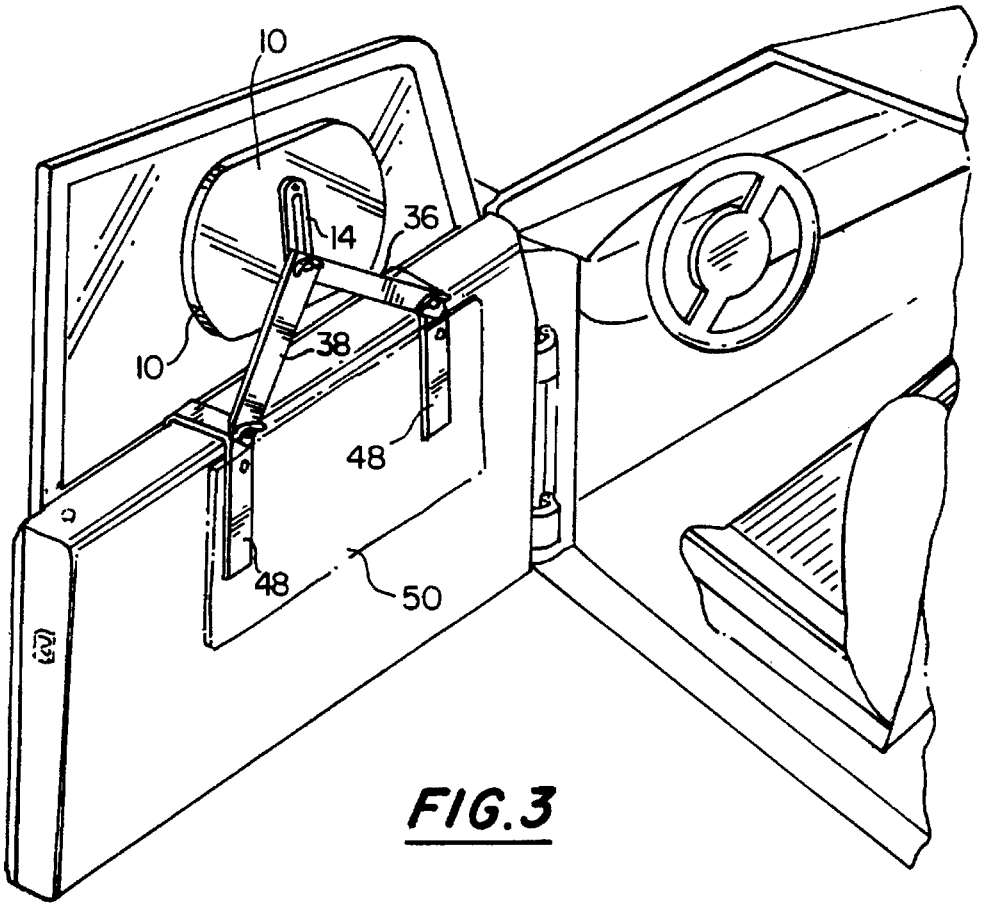
FIG. 3

PROJECTILE RESISTANT WINDOW SHIELD

BACKGROUND OF THE INVENTION

The present invention relates to a vehicle protective window and, in particular, to a vehicle protective window that is bullet resistant and mounts inside a vehicle door to provide protection for the occupants.

Making a vehicle bullet proof by using steel plates and very thick safety glass is well known. Applications of such armor proof vehicles range from protection of presidents and the highly visible wealthy people to military personel. Obviously, the construction of armor proof vehicles, using steel plates, etc., was very expensive and costly to operate, because of the added weight that required beefed-up tires, heavy suspension systems, increased gas consumption and the like.

With the advent of modern plastics it is possible to provide transparent plastics that are bullet resistant. Such plastics include aliphatic and alicyclic urethanes, plexiglas, polycarbonates and others.

Prior U.S. patents directed to transparent plastic window panels include the McDonald U.S. Pat. Nos. 3,855,898 and 3,923,339. The McDonald patents are directed to full armor after market protective panels for vehicle doors and windows. The entire inside of each door is covered with bullet resistant transparent plastic panels. Each panel is permanently attached to a door, forming a shield from the vehicle floor to its headliner.

While McDonald addresses the dangerous situation present in most urban areas, most people would not want to have the full armor protection offered in McDonald. In particular, there is a feeling among the general population that such full armor is demoralizing and demeaning. Also, encasing the inside of the vehicle with armor is cumbersome and confining to ordinary people. Of course, ordinary people do occasionally enter dangerous areas where protection is prudent. On those occasions a removable or permanently installed window protection offers security.

The present invention overcomes the prior problems associated with armor protection of vehicles. Most urban situations involving guns, include a criminal element which is inexperienced in marksmanship. Often the criminals use small caliber automatic weapons that they randomly shoot, The most important area of the body to protect is the upper body and head; therefore, a window shield which covers those vital areas is paramount. The window shield of the present invention does just that.

SUMMARY OF THE INVENTION

The window shield of the invention comprises a transparent bullet-resistant plastic shield mounted on the inside of a vehicle window. In the preferred embodiment, a bracket support having a vertical slide adjustment is mounted on a V-shaped bracket. The ends of the V-shaped bracket are attached to U-shaped hangers, where the hangers hang on the window sill between the sill and the window.

In another embodiment, the transparent bullet resistant plastic shield is mounted on one or more vertical brackets, which reciprocate vertically in a permanently mounted support with a spring means to secure the vertical bracket in a retained position.

Snaps are included with brackets for the attachment of additional protective panels for extended body coverage to the floor if desired. Kevlar, Steel and/or other protective material can be used.

The primary object of the invention is to provide a transparent projectile resistant window cover that can be permanently or removably attached to a vehicle window.

Another object of the invention is to provide a transparent bullet resistant window cover and a mounting means that is simple to operate and install.

These and other objects will become apparent from an understanding of the drawings and description.

DESCRIPTION OF THE DRAWINGS

FIG. 2 is a front plan view of a window shield of the invention.

FIG. 3 is a perspective view of a window shield of the invention mounted on a vehicle door.

DESCRIPTION OF THE INVENTION

Figure 1:
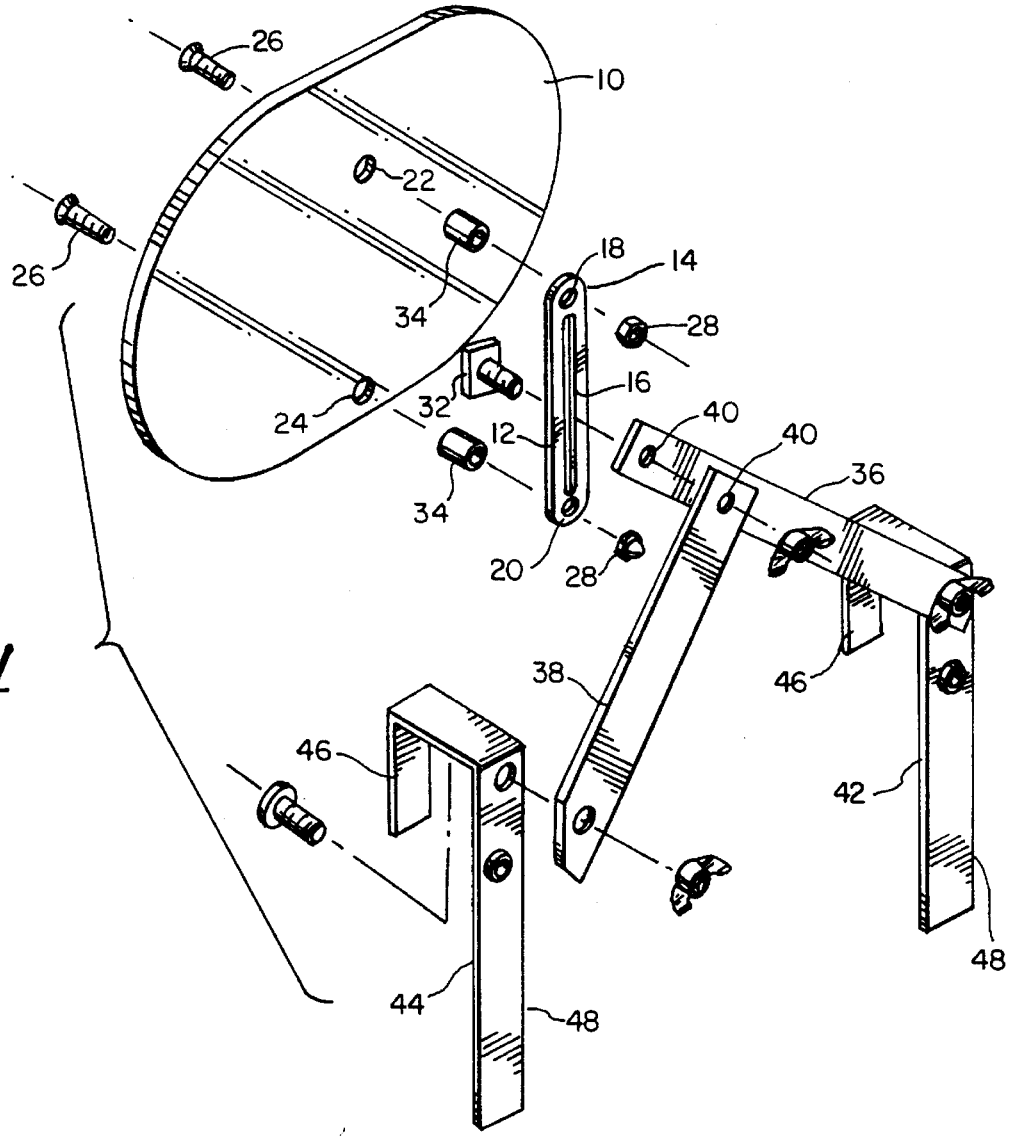
FIG. 1 is a perspective view of a window shield and mounting bracket of the invention.

Referring to the drawings, FIGS. 1–14, there is shown a window shield 10 of the invention. The window shield 10 is a clear transparent projectile resistant plastic. This material is an aliphatic or alicyclic urethane, plexiglas of other modern plastic suitable as bullet or projectile resistant material. Bullet resistant glass may also be used. A mounting bracket 12 having a vertical slide 14 for adjusting the height of the window shield, supports the window shield 10 on a vehicle door, as shown in FIG. 3.

The mounting bracket 12 has a vertical slide 14 with a slot 16 and apertures 18 and 20. The window shield 10 has a pair of apertures 22 and 24, which align with apertures 18 and 20 in slide 14. A pair of bolts 26 and nuts 28 fasten the slide 14 to the window shield 10. A stud 30 is inserted in slot 16 with end 32 captured between window shield 10 and slide 14, to allow window shield 10 and slide 14 to move vertically on stud 30.

A pair of spacers 34 provide a space for stud 30. A pair of arms 36 and 38 fasten to stud 30 via apertures 40 in each arm. The other ends of arms 36 and 38 are mounted to a pair of U-shaped brackets 42 and 44. Each of the U-shaped brackets has one leg 48 longer than the other leg 46. The U-shaped brackets 42 and 44 mount on the window sill with legs 46 inserted between the window and the sill. The longer legs 48 of each U-shaped bracket extends over the window sill as shown in FIG. 3, to stabilize the window shield on the inside of the door frame. Also, as shown in FIG. 3, a panel 50 of bullet resistant plastic may be attached to leg 48 to provide a larger area of protection.

In use, the mounting bracket 12 is assembled with the U-shaped brackets 42 and 44 connected to arms 36 and 38. The free ends of arms 36 and 38 are connected to each other and to stud 30. Since stud 30 is mounted in slot 16 of slide 14 and slide 14 is fixed to window shield 10, the window shield is adjustable up and down, and on an angle around stud 30.

FIG. 2 shows adjusting arms 36 and 38 to change the angles of the arms. By spreading the arms from position "a" to position "b" or vise versa, the window shield is raised or lowered without using slide 14.

Figure 4:
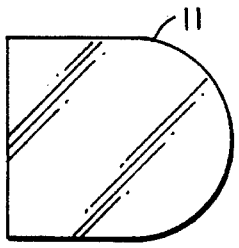
FIGS. 4–6 are front plan views of different window shield configurations.
Figure 5:
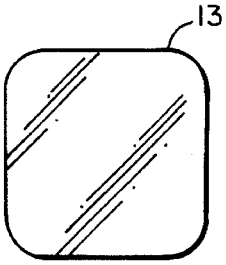
Figure 6:
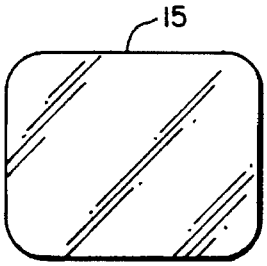

FIGS. 4, 5 and 6 show other window shield configurations that are usable with the mounting bracket 12. The window shield 11, FIG. 4, has an arcuate end and a straight end. FIG. 5 shows a square shaped window shield 13 with rounded corners. While in FIG. 6 window shield 15 is rectangular with rounded corners. The window shield 10 in FIG. 1 has an oblong shape with two rounded ends.

Figure 7:
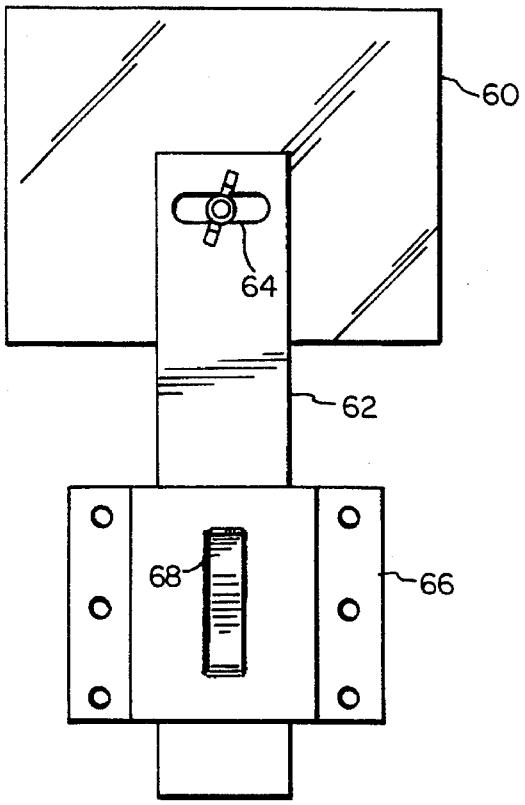
FIG. 7 is a front plan view of another embodiment of the invention.
Figure 9:
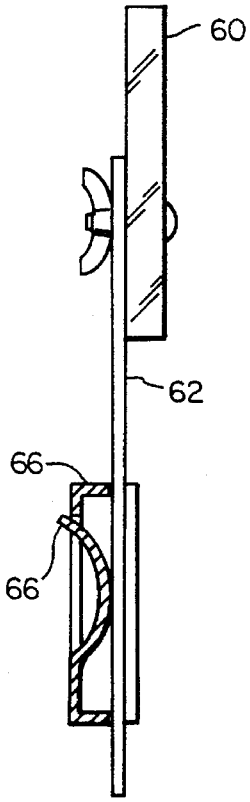
FIG. 9 is a side view with a sectional view taken along the line 9—9 of FIG. 8.
Figure 8:
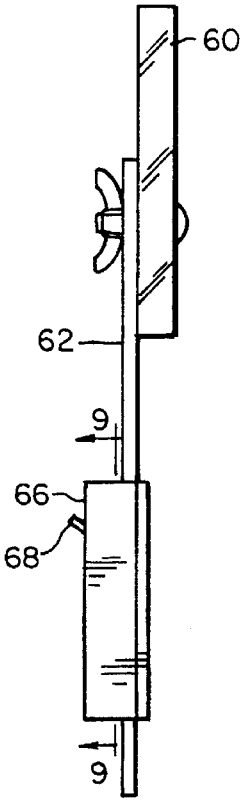
FIG. 8 is a side plan view of the embodiment of FIG. 7.

The embodiment shown in FIGS. 7, 8 and 9 includes a window shield 60, a verticle member 62 connected to the window shield by a bolt and wing nut. There is a slot 64 to adjust the position of the window shield horizontally. Vertical member 62 is received in a bracket support 66 which permanently mounts to the window sill of a vehicle. Vertical member 62 reciprocates vertically in bracket support 66. A spring lever 68 which is fixed to the bracket support 66, presses against vertical member 62 to hold it in a desired position.

Figure 10:
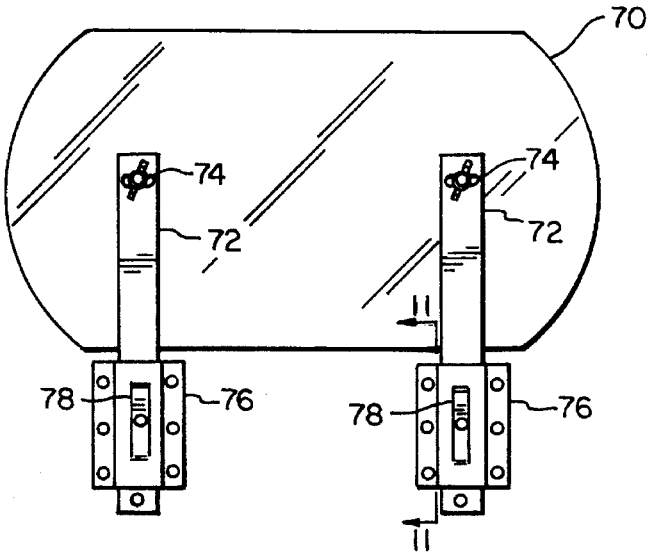
FIG. 10 is a front plan view of still another embodiment of the invention.
Figure 11:
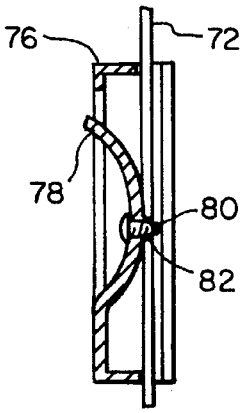
FIG. 11 is a cross sectional view taken along the line 11—11 of FIG. 10.

In FIGS. 10 and 11, another embodiment of the invention is shown. The window shield 70, which is larger than the window shield 60, has a pair of vertical members 72 connected to it by bolts and wing nuts. There are slots 74 which allow horizontal movement. The vertical members 72 are received in bracket supports 76 which mount on a vehicle window sill. Vertical members 72 reciprocate vertically in bracket supports 76. Spring levers 78 are affixed on the bracket supports, each lever having a projection 80 which engages apertures 82 in each vertical member to hold the window shield 70 in an extended position.

Figure 12:
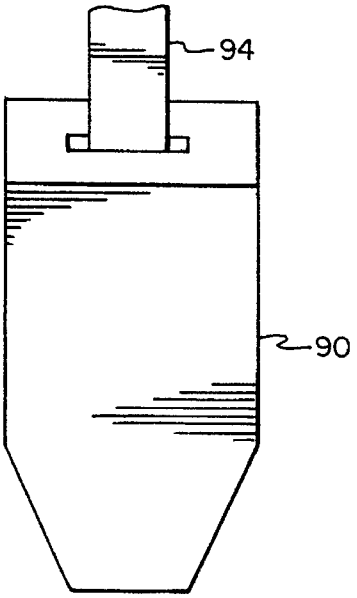
FIG. 12 is still another embodiment of the invention.
Figure 13:
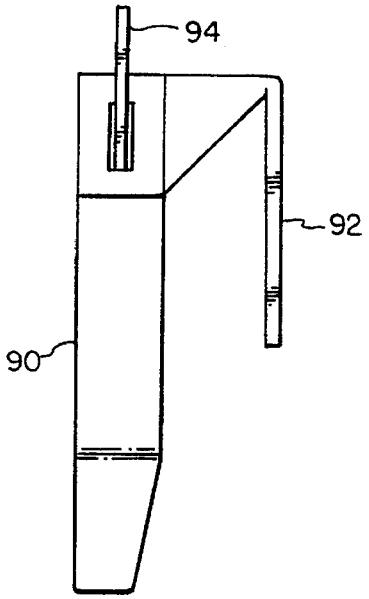
FIG. 13 is a side plan view of FIG. 12.
Figure 14:
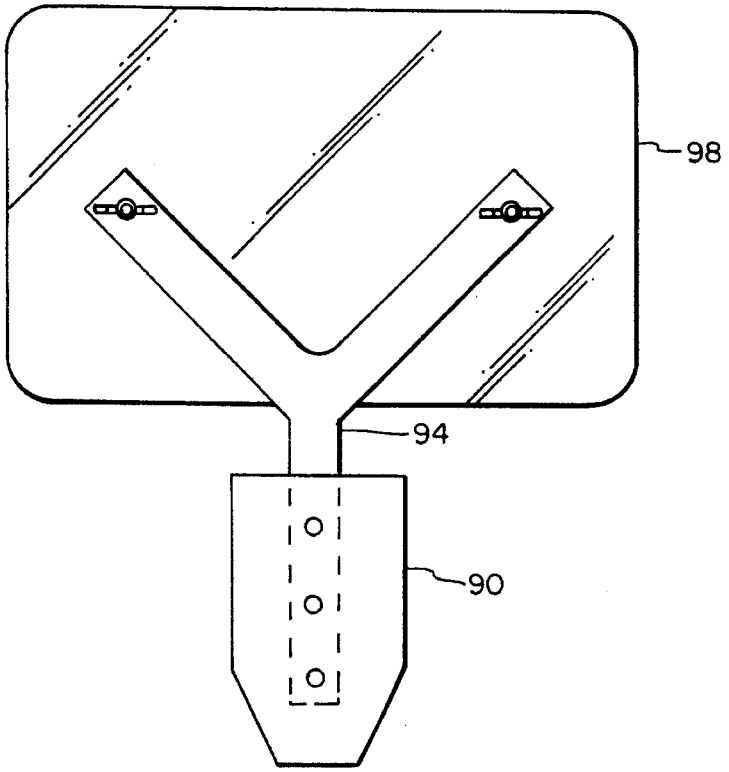
FIG. 14 is a front plan view of the embodiment of FIG. 12.

FIGS. 12, 13 and 14 show another embodiment of the invention where the bracket supports 90 can be removably mounted on a vehicle window sill. FIG. 13 has a hook 92 which extends between the window and the sill to support window shield 98. A vertical member 94 extends from the bracket supports 90 and reciprocates vertically. In FIG. 14, vertical member 94 is Y-shaped to connect to the window shield in two places. The bracket support 90 has a spring lever as in FIGS. 7–11 to adjust the height of the window shield 98.

While various embodiments of the invention have been disclosed, it is understood that other embodiments may be realized. Therefore, for a complete understanding of the invention one should consider the drawings, specification and claims.

What is claimed is:

1. A window shield for mounting on the inside of a side window of a vehicle door to protect persons in a vehicle from injury from projectiles comprising:

a transparent projectile resistant window shield of a size to substantially cover the inside of a vehicle side window;

an adjustable support means for attaching said window shield to a vehicle door window frame, said vehicle door window frame having a window sill to which said adjustable support means connects wherein said adjustable support means comprises:

a vertical bracket means mounted on said window shield, where said vertical bracket means has a vertical longitudinal slot, and a captured stud slidable in said. longitudinal slot; and, an adjustable inverted V-shaped bracket connected to said vertical bracket means by said captured stud, and having a pair of inverted U-shaped brackets for connecting to said window sill.

2. A window shield as in claim 1 wherein said adjustable inverted V-shaped bracket includes a pair of arms connected to one another at one end by said captured stud and a threaded fastener, whereby said arms pivot about said captured stud to change the angle of said adjustable inverted V-shaped bracket and thereby adjustably raising or lowering said window shield.

3. A window shield as in claim 2 wherein said pair of inverted U-shaped brackets are pivotally connected to said arms, each having a first integral arm and a second integral arm, said second integral arm being longer than said first integral arm whereby said first integral arm inserts between the vehicle window and said window sill and said second integral arm extends over said window sill to stabilize said window shield on the inside of said vehicle door window frame.

* * * * *